US009301574B2

(12) United States Patent
Smith, III

(10) Patent No.: US 9,301,574 B2
(45) **Date of Patent: *Apr. 5, 2016**

(54) INTERNALLY ILLUMINATED LIGHT DIFFUSING FOOTWEAR

(71) Applicant: Roy Robert Smith, III, Sugar Land, TX (US)

(72) Inventor: Roy Robert Smith, III, Sugar Land, TX (US)

( * ) Notice: Subject to any disclaimer, the term of this patent is extended or adjusted under 35 U.S.C. 154(b) by 81 days.

This patent is subject to a terminal disclaimer.

(21) Appl. No.: 14/632,655

(22) Filed: Feb. 26, 2015

(65) Prior Publication Data

US 2015/0164181 A1 Jun. 18, 2015

Related U.S. Application Data

(63) Continuation of application No. 14/081,865, filed on Nov. 15, 2013, now Pat. No. 8,992,038.

(60) Provisional application No. 61/747,070, filed on Dec. 28, 2012.

(51) Int. Cl.

| | |
|---|---|
| ***A43B 23/24*** | (2006.01) |
| ***A43B 3/00*** | (2006.01) |
| ***F21V 9/00*** | (2015.01) |
| ***F21V 23/02*** | (2006.01) |
| ***F21V 33/00*** | (2006.01) |
| *F21W 121/06* | (2006.01) |
| *F21Y 101/02* | (2006.01) |

(52) U.S. Cl.

CPC ..... *A43B 23/24* (2013.01); *A43B 3/001* (2013.01); *A43B 3/0078* (2013.01); *F21V 9/00* (2013.01); *F21V 23/023* (2013.01); *F21V 33/0008* (2013.01); *F21W 2121/06* (2013.01); *F21Y 2101/02* (2013.01)

(58) Field of Classification Search

CPC ... F21L 4/027; F21Y 2101/02; A43B 3/0005; A43B 3/001; A43B 1/0072; A43B 1/0027; A43B 3/0078; A43B 5/16; A43B 23/24; F21V 33/008; F21V 9/00; F21V 23/023; F21V 33/0008; F21W 2121/06

See application file for complete search history.

(56) References Cited

U.S. PATENT DOCUMENTS 8,992,038 B2 * 3/2015 Smith, III ..... A43B 3/001 36/137
2006/0262517 A1 * 11/2006 Doerer ..... A43B 3/001 362/103

* cited by examiner

*Primary Examiner* — Stephen F Husar
*Assistant Examiner* — Danielle Allen

(57) ABSTRACT

An illumination system is housed in a footwear, the footwear including a sole and an upper. An interfacing layer and a liner form inner interior layers connected to the upper. A plurality of illumination sources are electrically connected to a power source and positioned adjacent to the liner. The illumination sources are positioned between the liner and upper. The upper has a light diffusing section. The light emitted from the plurality of illumination sources is diffused as it passes through the light diffusing section of the upper. Aesthetic designs can be creating, either through the arrangement of the plurality of illumination sources or the provision of a light impermeable section on the upper. The light impermeable section, in combination with the light diffusion section, can be used to form or outline an aesthetic design. The result is an internally illuminated footwear with diffused light.

10 Claims, 18 Drawing Sheets

INTERNALLY ILLUMINATED LIGHT DIFFUSING FOOTWEAR

The current application is a continuation of U.S. Non-Provisional patent application Ser. No. 14/081,865 filled Nov. 15, 2013, which claims benefit of U.S. Provisional Patent application Ser. No. 61/747,070 filed Dec. 28, 2012.

FIELD OF THE INVENTION

The present invention relates generally to footwear comprising of textile components with an internal illumination system and means of displaying internally illuminated graphics, designs and logos by diffusion of light from the internal illumination system.

BACKGROUND OF THE INVENTION

Footwear has long been produced in various combinations of leather, synthetics, plastics and textiles. These various materials have been used and combined together in the production of footwear over many decades for the purposes of fashion, design, function, and comfort. For many decades, materials such as glitter, stones, rein-stones and sequins have been used to enhance the fashion and design detail of footwear. In more recent decades, lights have been added to this list. Used to enhance the interest, novelty and attractiveness of children's footwear, LED lights have been attached to footwear and in some manner exposed to the eye of the observer, so that, when activated the LED lights will clearly be seen and attract attention. Footwear that comprise LED lights such as this, are often referred to as "illuminated", "illuminated footwear", "light-up shoes" and or "shoes that light up". While the concept of LED illuminated shoes is not new to the footwear industry, there are a wide variety in applications of illumination systems and constructions of footwear with illumination systems, both integrated and external.

The present invention focuses on the adoption and improvement of internally illuminated footwear. More specifically, by providing a light diffusing textile upper, a new application of internally illuminated footwear is provided. In addition to the diffusion of light from internal illumination sources, light impermeable sections can be incorporated in order to create aesthetic designs as part of the footwear.

It is therefore the purpose of this invention to internally illuminate the textile components of footwear, while providing a means of displaying and illuminating designs, graphics and logos.

DETAIL DESCRIPTIONS OF THE INVENTION

Figure 1:
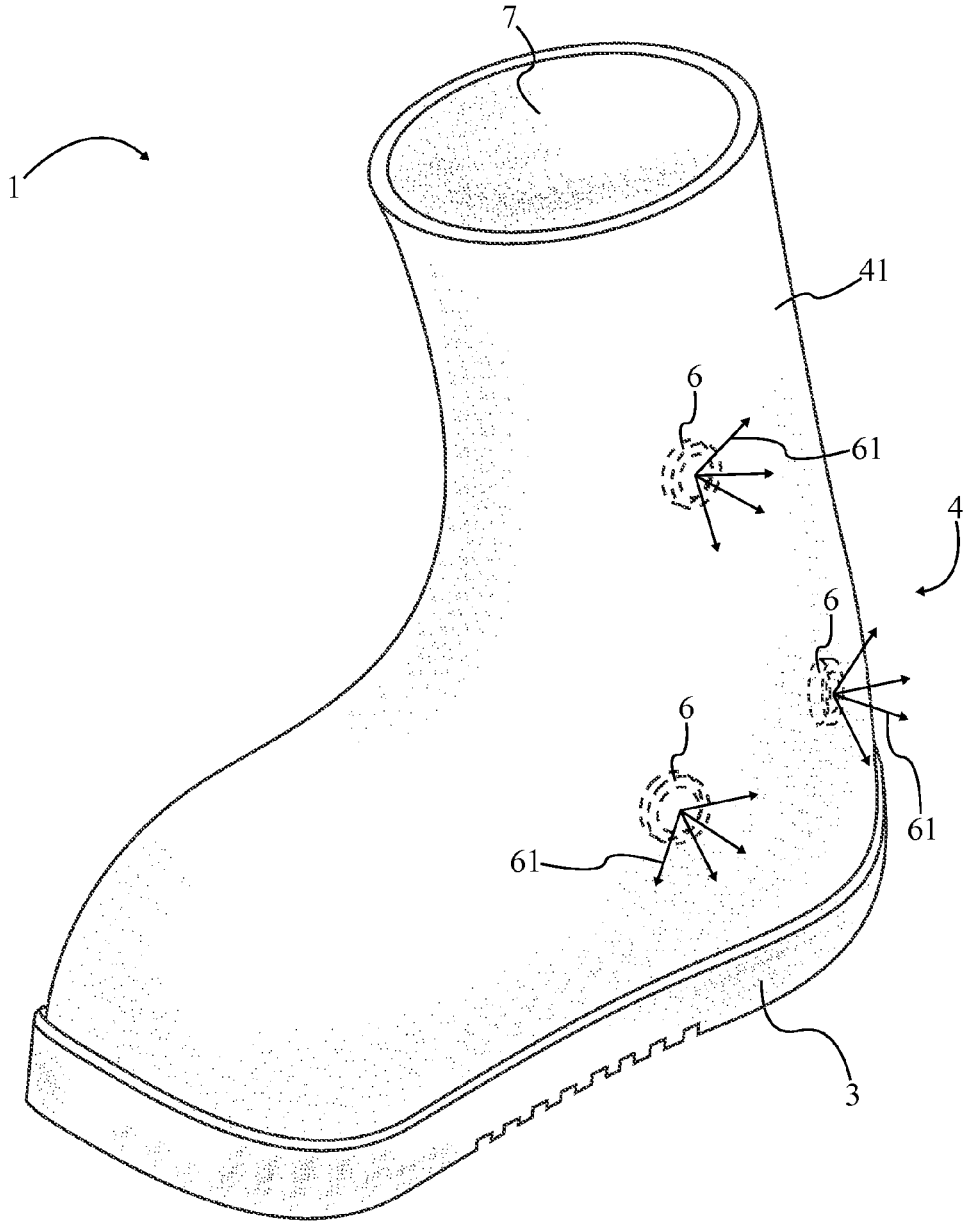
FIG. 1 is a perspective view of a left foot of the present invention showing an illumination source in dotted line.
Figure 2:
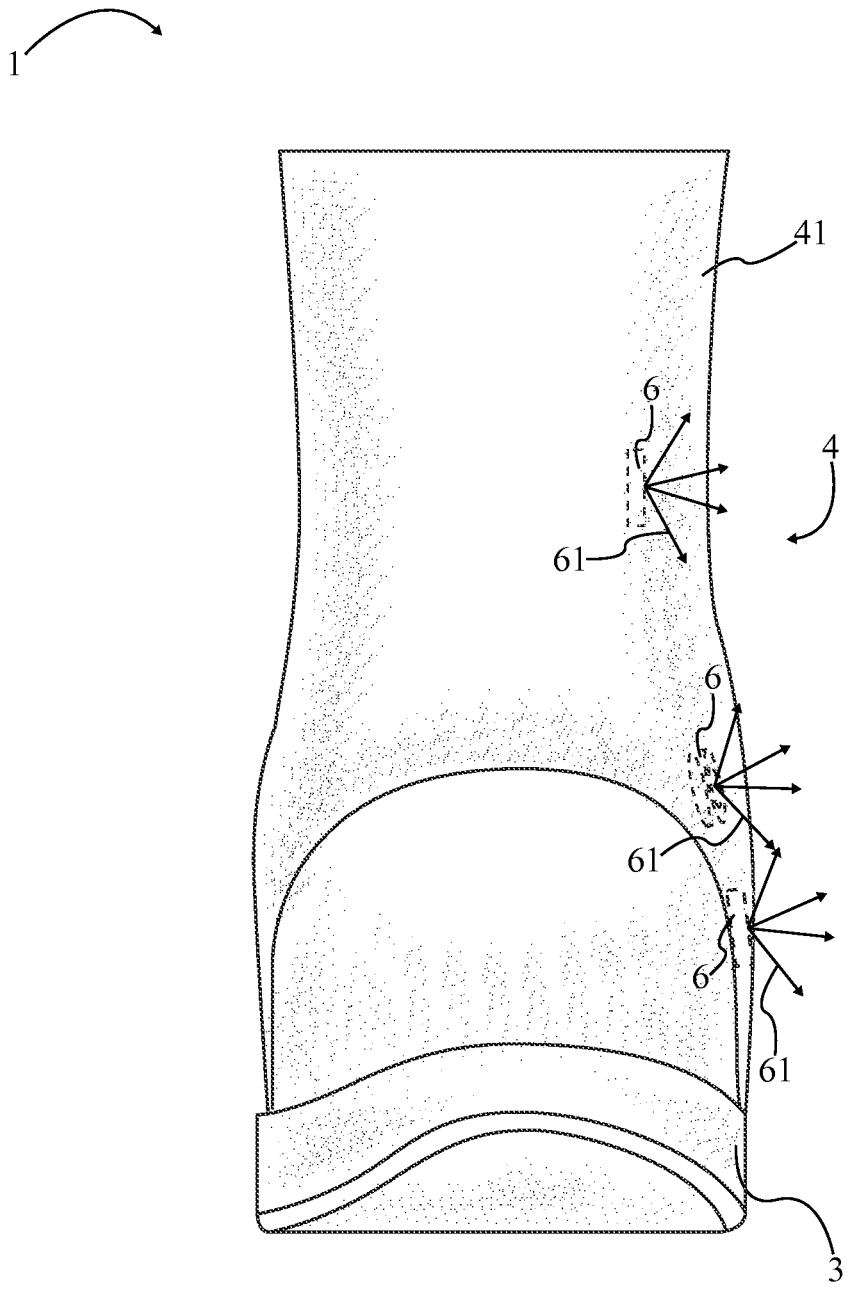
FIG. 2 is a front view of a left foot of the present invention showing an illumination source in dotted line.
Figure 3:
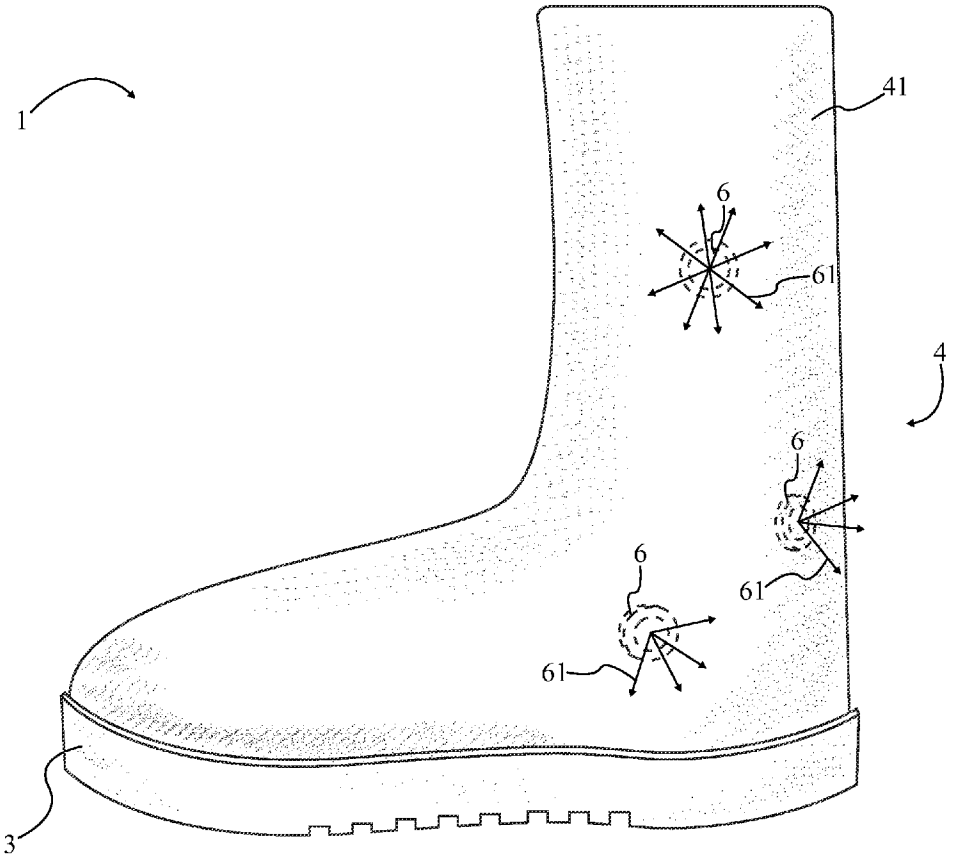
FIG. 3 is a right view of a left foot of the present invention showing an illumination source in dotted line.
Figure 4:
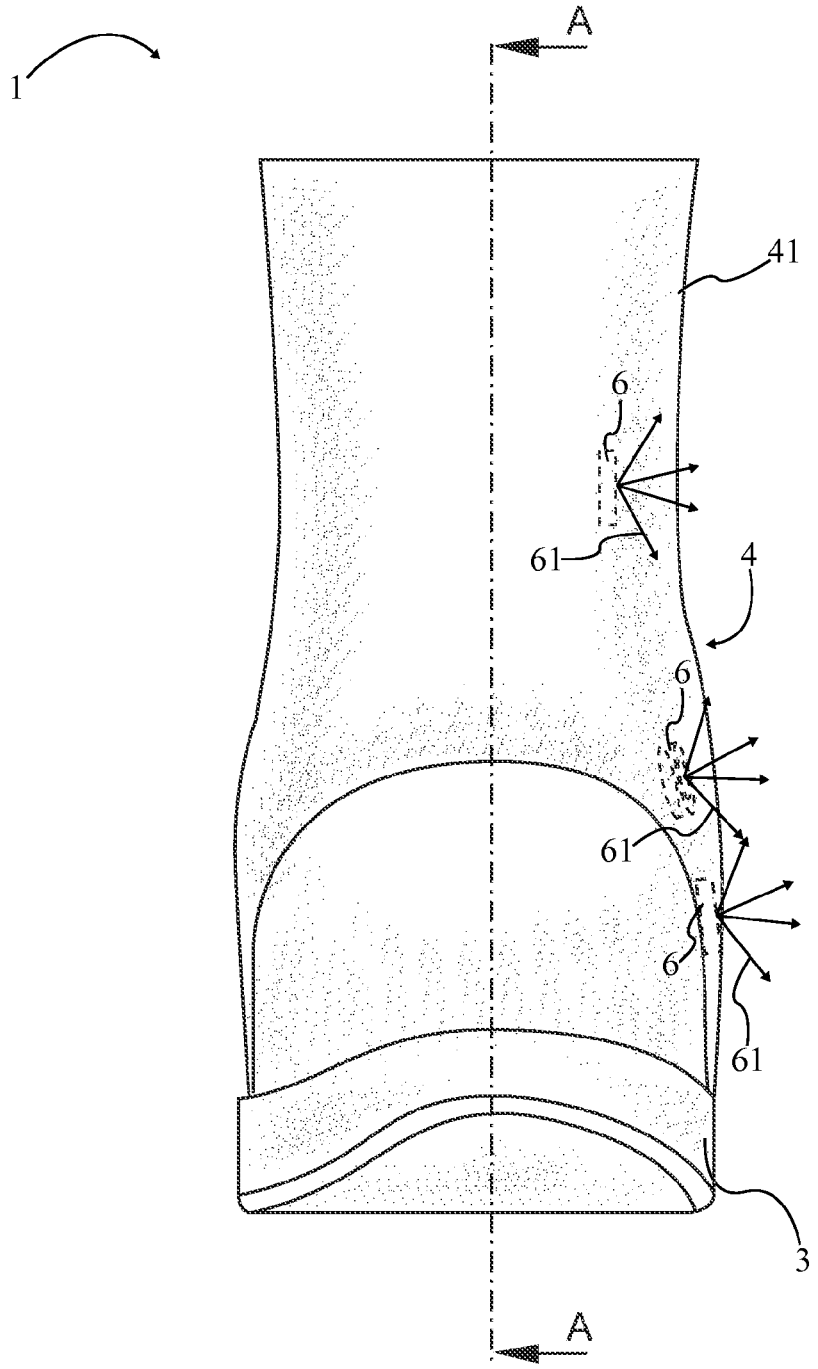
FIG. 4 is a front view of a left foot of the present invention, showing the plane upon which a cross-sectional view is taken and shown in FIG. 5A.

All illustrations of the drawings are for the purpose of describing selected versions of the present invention and are not intended to limit the scope of the present invention.

The present invention is an internally illuminated footwear 1 with light diffusing layers that results in the visual impression of radiant illumination, shown in FIG. 1-FIG. 4, FIG. 6A-FIG. 6E, and FIG. 7-FIG. 9. The present invention comprises a footwear 1 and an illumination system 2, the latter of which is housed in the former. The footwear 1 itself comprises a sole 3 and an upper 4, with upper 4 being perimetrically connected to the sole 3. The illumination system 2 comprises a power source 5 and a plurality of illumination sources 6. The plurality of illumination sources 6 are positioned between the liner 7 and the upper 4, interior to the footwear 1, thus internally illuminating the footwear 1. The illuminating light 61 itself is represented as arrows, providing a visual example of diffused light.

As seen in FIG. 5A, FIG. 5B, and FIG. 6B-FIG. 6E, the present invention further comprises a liner 7 and a structure 8, each of which are positioned in the interior of the footwear 1. The structure 8 is designed to be adjacently connected to the inner surface of the upper 4, with the structure 8 resultantly being positioned between the liner 7 and the upper 4. The structure 8 itself comprises an interfacing layer 9 and a batting 10, which enhance the visual aspects of the illumination sources 6 of the present invention. These are visible in FIG.

5A, FIG. 5B, FIG. 6B-FIG. 6E, and FIG. 10. The interfacing layer 9 is a reflective layer that serves as a connection point for the plurality of illumination sources 6, that are adjacently connected to the interfacing layer 9 opposite the liner 7. Ultimately, the plurality of illumination sources 6 are positioned between the interfacing layer 9 and the batting 10. The reflective interfacing layer 9 maximizes the amount of light 61 that exits through the batting 10, while the batting 10 serves as a first layer of light diffusion, distributing light over a larger area of batting 10, before the light 61 exits the batting 10 and into the diffusing section 41 of the upper 4. After entering the diffusing section 41 the light is once again diffused and spread out across a larger area of the upper 4 which creates the visual effect of diffused light sources. The interfacing layer 9, used in the art to provide structural reinforcement, is also beneficial as it adds virtually no bulk or weight to the present invention while reducing the difficulty of and increasing the efficiency of the manufacturing process as it relates to the installation of illumination sources 6. The size of the interfacing layer 9 and batting 10 is variable, such that it can encompass the entire area of the upper 4 or be scaled down to form a small panel in the vicinity of the illumination sources 6, with the panel formed by the interfacing layer 9 and batting 10 is being formed in the area where an illumination effect is desired. Any appropriate method of connection can be used to secure the plurality of illumination sources 6 to the interfacing layer 9. For example, the plurality of illumination sources 6 can be glued or stitched to the interfacing layer 9. Likewise, there are a variety of options for providing the plurality of illumination sources 6. One of the most common choices is the light emitting diode, or LED, but other methods are possible too. For example, there exists electroluminescent wire which provides a continuous light source when subjected to current, compared to the more discrete nature of LEDs. In the preferred embodiment, surface mounted LEDs are used. Surface mounted LEDs are advantageous because 100% of the light 61 can be directed outwards, through the batting and upper, improving efficiency of the illumination system 2. Additionally, the LEDs are provided with a wide viewing angle, such that even a single illumination source 6 illuminates a large area of the present invention.

Figure 7:
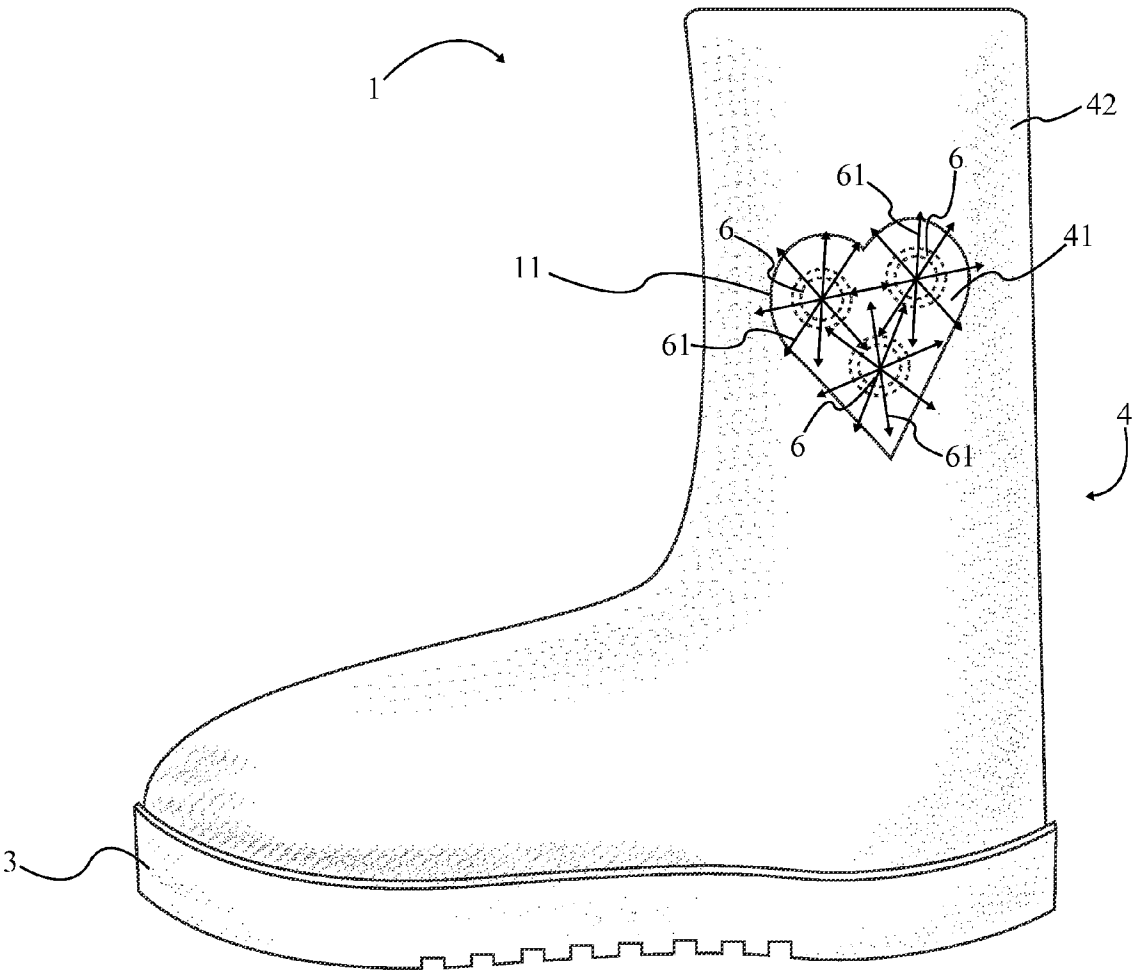
FIG. 7 is a right view of a left foot of the present invention showing a first variant of the upper of the present invention with the upper having an aesthetic design formed by a light diffusing section.

In one variant of the preferred embodiment, the upper 4 further comprises a light impermeable section 42, which could possibly be leather. This light impermeable section 42, rather than diffusing light 61, blocks all passage of light 61. As a result, the plurality of illumination sources 6 will not be visible through the light impermeable section 42. They will, however, still be visible through the light diffusing sections 41 (i.e. a sheer textile) of the upper 4. By using the light impermeable section 42 in conjunction with the light diffusing section 41, this second embodiment is capable of creating an aesthetic design 11. The aesthetic design 11 is created using the contrast between the light impermeable section 42 and the light diffusing section 41. In this second embodiment, the light diffusing section 41 is configured as the aesthetic design 11. For example, providing a heart as the aesthetic design 11, the light diffusing section 41 would be heart shaped. The rest of the upper 4 is formed by the light impermeable material. As a result, the light 61 from the plurality of illumination sources 6 is only capable of passing through the heart-shaped light diffusing section 41. This gives the appearance of a heart-shaped light source on the exterior of the present invention, though in reality the illumination source 6 is internally located. This variant is illustrated in FIG. 7.

Figure 8:
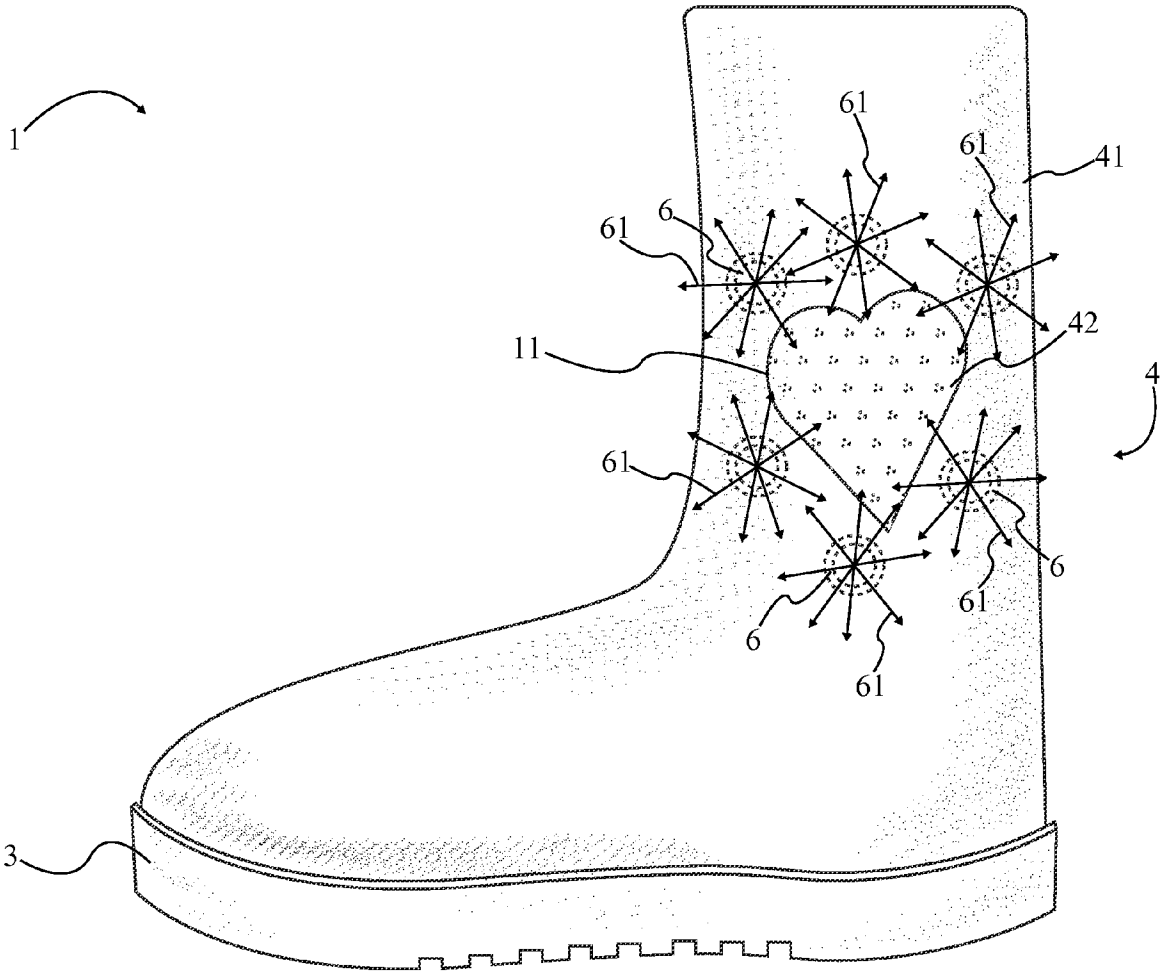
FIG. 8 is a right view of a left foot of the present invention showing a second variant of the present invention with the upper having an aesthetic design formed by a light impermeable section.

In another variant of the preferred embodiment, the upper 4 again comprises a light impermeable section 42 in addition to the light diffusing section 41, similar to the described first variant. However, in a reversal of the first variant, in the second variant the light impermeable section 42 is configured as the aesthetic design 11. This creates a stencil effect, as the light impermeable section 42 prevents passage of light 61. Rather than being defined by the emitted light 61, the aesthetic design 11 is defined by an area with no emitted light 61, outlined by the surrounded light diffusing section 41. This variant is illustrated in FIG. 8.

The two aforementioned variants describe the aesthetic design 11 as being integrated into the upper 4, but in another embodiment the aesthetic design 11 could be provided as part of the structure 8. Described in more detail later, this can be accomplished by integrating light impermeable properties into the structure 8.

In both the aforementioned variants, the aesthetic design 11 is positioned adjacent to the plurality of illumination sources 6. This is done so that the light 61 from the plurality of illumination sources 6 can be diffused through the aesthetic design 11 (i.e. the first variant) or so that the light 61 from the plurality of illumination sources 6 can outline the aesthetic design 11 (i.e. the second variant). As shown in FIG. 7 and FIG. 8, by properly aligning the plurality of illumination sources 6 and the aesthetic design 11 the maximum amount of light 61 is available for defining the aesthetic design 11.

Figure 9:
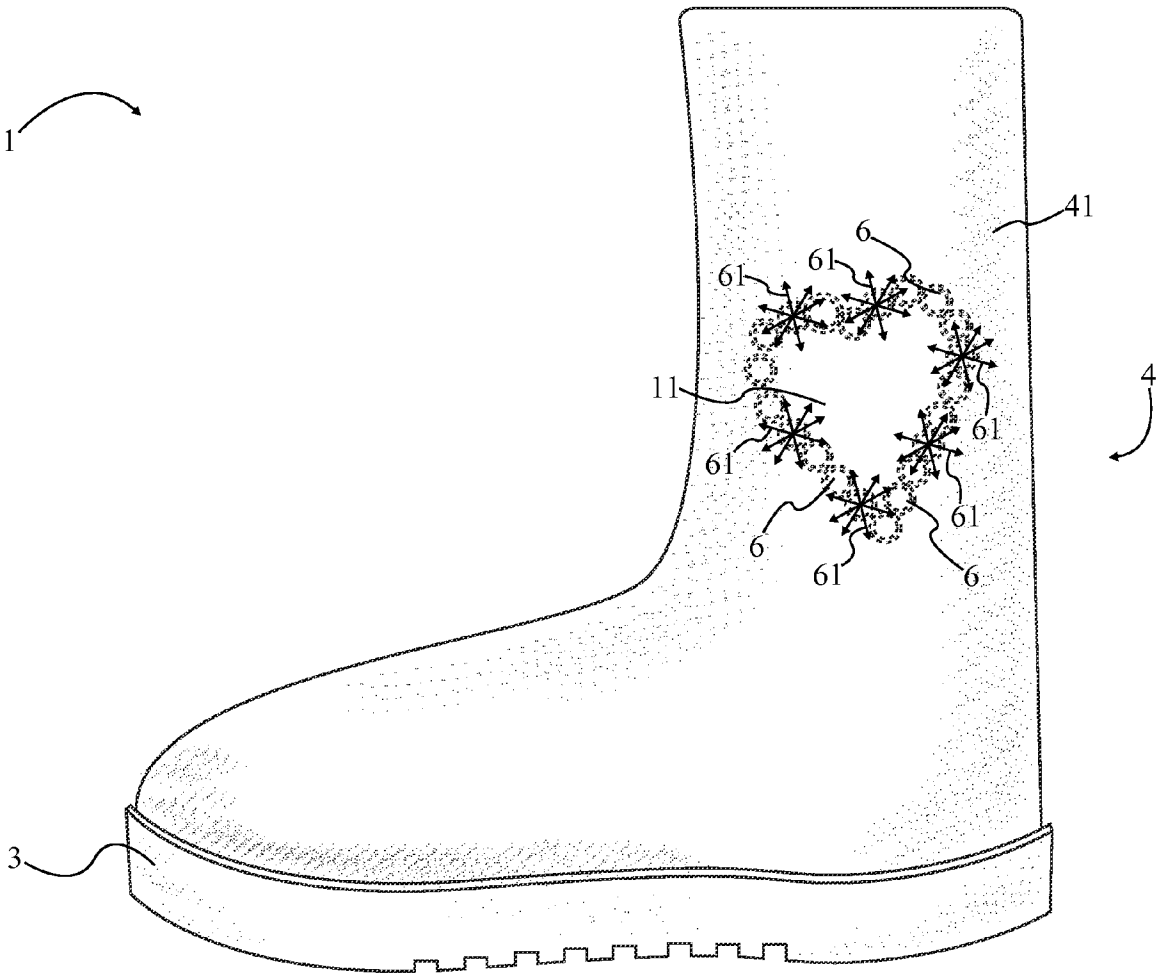
FIG. 9 is a right view of a left foot of the present invention showing a third variant of the present invention with an aesthetic design being formed by the illumination sources.
Figure 10:
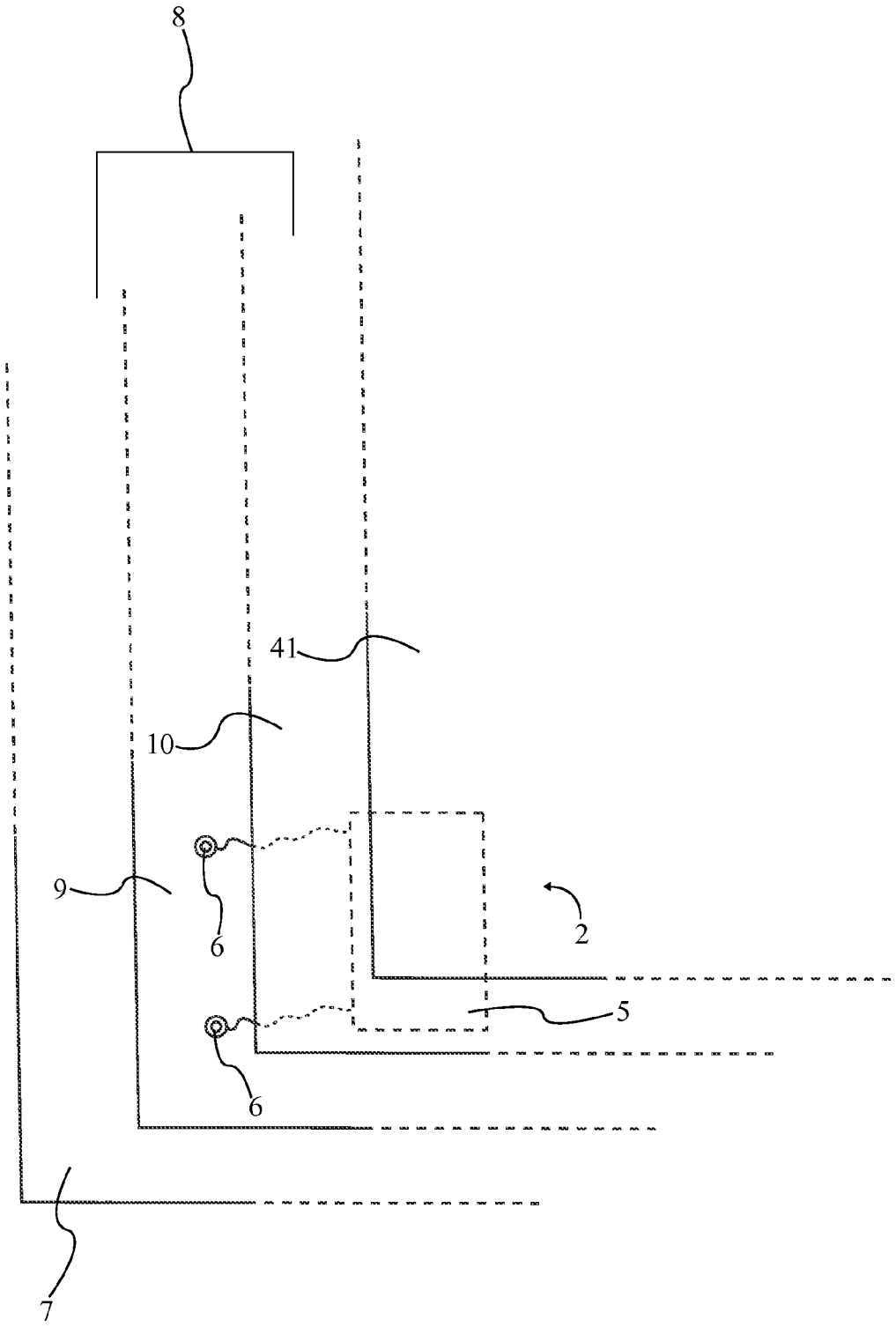
FIG. 10 is a diagram of the present invention showing a structure between the liner and the upper.

In a third variant of the preferred embodiment, the plurality of illumination sources 6 are arranged in a pattern to form the aesthetic design 11. This variant uses the plurality of illumination sources 6 to delineate the aesthetic design 11. Returning to the example of a heart-shaped aesthetic design 11, in this variant the plurality of illumination sources 6 are positioned to form the outline of the heart shape. Because the plurality of illumination sources 6 themselves are used to form the aesthetic design 11, the outline and interior of the aesthetic design 11 will not necessarily be distinct as with the first and second variants. The intensity of light 61 may not be sufficient to completely fill the center part of the aesthetic design 11. Instead, a gradient of light intensity occurs, producing a visually pleasing glow for the aesthetic design 11. It is noted that in this third embodiment, the light diffusing section 41 fully and solely forms the illuminated upper 4, with the light impermeable section 42 being omitted. This variant is illustrated in FIG. 9.

The described light diffusing section 41 is made from a sheer material which is sufficiently dense to obscure human sight, while still allowing for the passage and diffusion of light 61. Essentially, the light diffusing section 41 must be able to hide the plurality of illumination sources 6 without blocking the light 61 produced by the plurality of illumination sources 6. Textile materials, examples of which include but are not limited to fabric materials (whether synthetic, a blend of synthetic and natural, or a blend of synthetics) and nature materials, are just one possible material type which can be used for the light diffusing section 41.

The light impermeable section 42, used to completely block light 61 from the plurality of illumination sources 6, is made from materials which are dense enough to obscure the plurality of illumination sources 6 from view as well as prevent the passage of visible light 61. As part of the upper 4, the light impermeable section 42 is preferably soft and flexible, in addition to being opaque, allowing it to be properly positioned around the light diffusing section 41 (such as in the second embodiment, shown in FIG. 7) or overlapping the plurality of illumination sources 6 (such as in the third embodiment, shown in FIG. 8). The light impermeable section 42 may be any opaque material suitable for footwear such as leather or polyurethane, as well as imitation leathers produced from polyurethane and like material. Even textile materials may be used, which may require a separately attached lining or structure 8 to insure that the specific textile is completely opaque.

The aesthetic design 11, whether configured from the plurality of illumination sources 6, the light diffusing section 41, or the light impermeable section 42, can be implemented in a number of forms. As an example, the aesthetic design 11 could comprise graphics or logos, or even a combination thereof. As an example, the above embodiments describe an aesthetic design 11 in the shape of a heart. However, the aesthetic design 11 could take any number of different forms, whether images or text. While any type of illumination source 6 can be used for the aesthetic design 11, some types of illumination sources 6 may be more appropriate for certain aesthetic designs 11. For example, the continuous nature of electroluminescent wire is more ideally suited to illuminating text, especially if the illumination sources 6 themselves are forming the aesthetic design 11, as in the fourth embodiment. Potentially, the third variant could utilize an electroluminescent panel as the illumination source 6, with the electroluminescent panel being cut to the appropriate shape and size for the aesthetic design 11.

Figure 11:
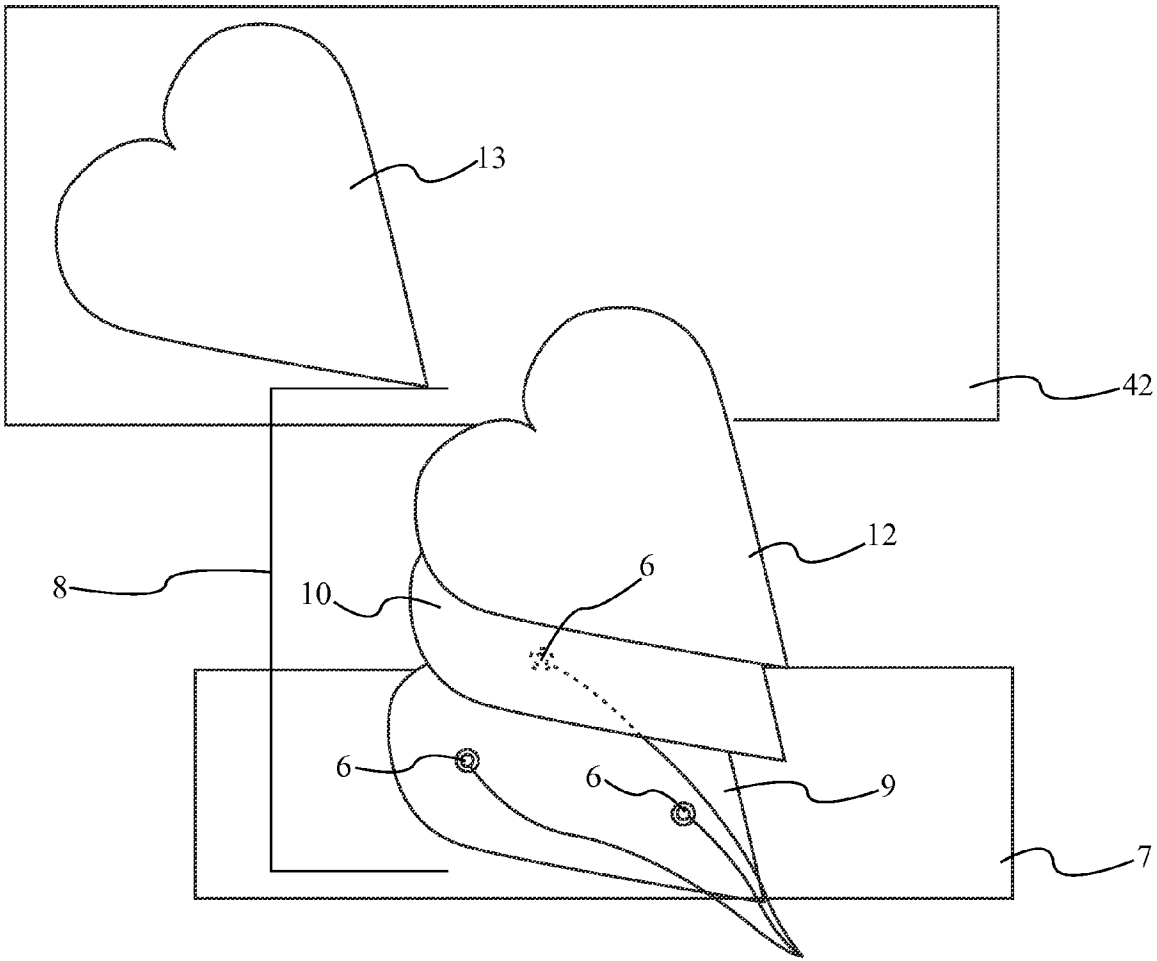
FIG. 11 is a diagram of an alternative embodiment of the present invention showing an aesthetic design being formed by a light diffusing section of the structure and an aesthetic cut of the upper.

In a second embodiment of the present invention, the structure 8 further comprises a light diffusing layer 12. The light diffusing layer 12 is similar to the light diffusing section 41 of the preferred embodiment, and as such is preferably made from a sheer material, such as the textile material defined earlier in the application. The layout of the layers of this embodiment are illustrated in FIG. 11. This is provided as an alternate construction for the present invention, which functions by integrating the aesthetic design 11 into the structure 8 rather than creating the aesthetic design 11 as part of the upper 4 itself. This embodiment serves to simplify construction of the upper 4. This light diffusing layer 12 is an additional layer connected adjacent to the batting 10, opposite the interfacing layer 9. As with the preferred embodiment thelight diffusing layer 12, similar to the batting 10, serves to diffuse light 61 and create the impression that point sources of light 61 such as the plurality of illumination sources 6 provide a diffuse glow which is aesthetically appealing. The light diffusing layer 12 is configured as an aesthetic design 11, such that it forms a shape, logo, or other visual component when the structure 8 is connected to the upper 4. Correspondingly, the upper 4 itself is configured as an at least one aesthetic cut 13. The remainder of the upper 4 is light impermeable, for example being made of a leather material. The aesthetic cut 13 traverses through the upper 4, creating a hole which allows light 61 from the plurality of illumination sources 6 and the light diffusing layer 12 to be seen. The light diffusing layer 12 and the aesthetic cut 13 are perimetrically aligned with each other, providing a clear visual distinction between the light impermeable upper 4 and the aesthetic design 11. By directly connecting the structure 8 to the upper 4 and ensuring alignment of the aesthetic design 11 and the aesthetic cut 13, a tight seal is produced that only allows light 61 to escape through the aesthetic design 11. This serves to eliminate leakages of light 61 which would detract from the overall appearance. The end result is an internally illuminated textile footwear 1 which has a diffusely illuminated aesthetic design 11 integrated into the footwear 1 construction.

Figure 12:
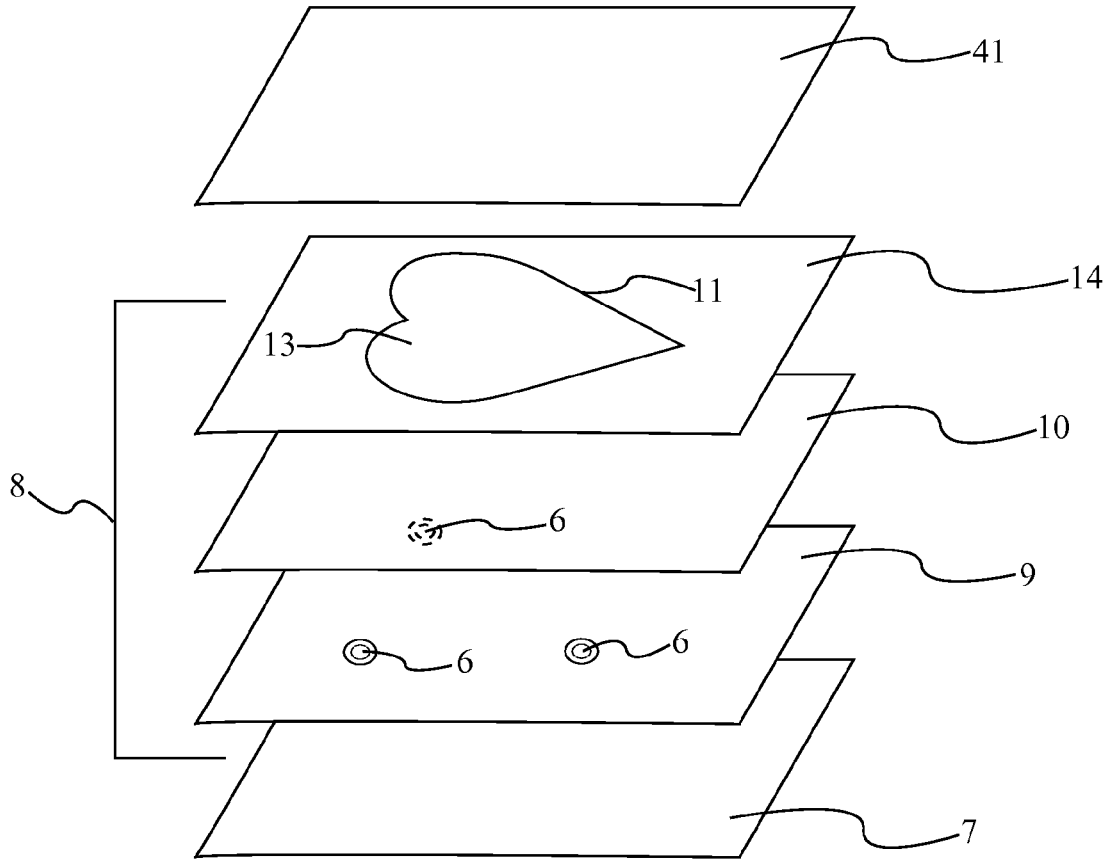
FIG. 12 is a diagram of an alternative embodiment of the present invention showing an aesthetic design being formed by an aesthetic cut of a stencil layer of the structure.
Figure 13:
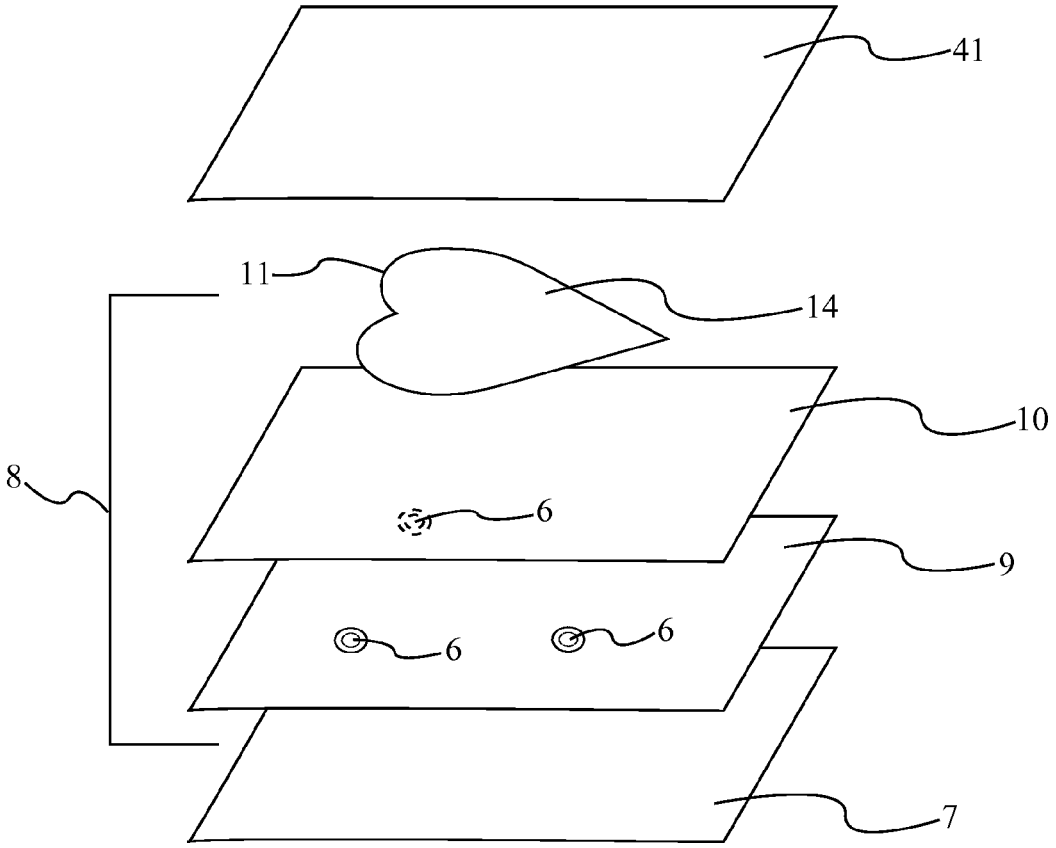
FIG. 13 is a diagram of an alternative embodiment of the present invention showing an aesthetic design being formed by light impermeable stencil layer of the structure.

In a third embodiment of the present invention, shown in FIG. 12 and FIG. 13, the structure 8 comprises a stencil layer 14 in place of the light diffusing layer 12. This alternative embodiment is designed to be used with an upper 4 made from a sheer textile material, acting as a light diffusing section 41. The stencil layer 14 is provided to block a portion of light 61 from passing through the upper 4, such that the transmitted light 61 creates an aesthetic design 11. The stencil layer 14 can be implemented in two variants, making use of the concepts of positive space and negative space. In each variant, the stencil layer 14 is adjacently connected to the batting 10 opposite the interfacing layer 9.

In the first variant, the stencil layer 14 is light impermeable, blocking the passage of light 61 between the batting 10 and the upper 4. The stencil layer 14 comprises an at least one aesthetic cut 13, which traverses through the stencil layer 14 and thus allows for the passage of light 61. The plurality of illumination sources 6 are subsequently positioned adjacent to the aesthetic cut 13, acting to illuminate the area of the aesthetic cut 13 with diffuse light 61. The light 61 is able to pass through the aesthetic cut 13 and the light diffusing section 41 of the upper 4, becoming visible to an observer. Once connected to the inner surface of the upper 4, this first variant provides the visual impression of an integrated illuminated design for a footwear 1. For example, if the aesthetic cut 13 is heart-shaped, the footwear 1 would appear to have a diffusely illuminated heart as part of the upper 4. The layout of this variant is visible in FIG. 12.

In the second variant, as with the first variant, the stencil layer 14 is light impermeable. Unlike the first variant, the stencil layer 14 of the second variant is configured as an aesthetic design 11, rather than comprising an aesthetic cut 13. By providing the stencil layer 14 in an aesthetic design 11, the illumination sources 6 serve to outline the aesthetic design 11, rather than illuminating the aesthetic design 11 itself. For example, if the aesthetic design 11 is heart-shaped, an observer would see an illuminated upper 4 with an unlit heart shape being positioned in the illuminated upper 4. The heart shape is produced because the light impermeable stencil layer 14 blocks light 61 from the illumination sources 6, creating an unlit area that ultimately acts as the desired visual design. The layout of this variant is visible in FIG. 13.

Effectively, by providing a stencil layer the present invention can use the illumination sources 6 to illuminate an aesthetic design, or to instead illuminate the area around an aesthetic design.

Figure 5A:
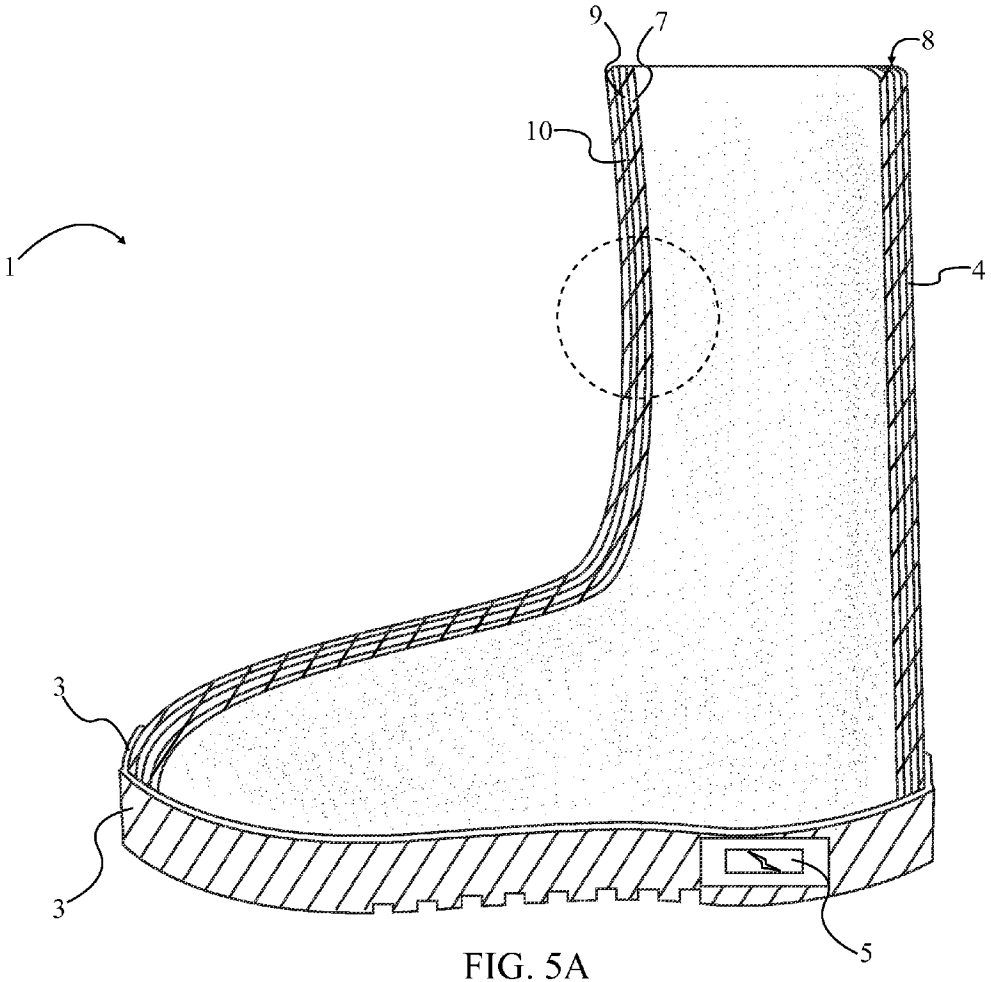
FIG. 5A is a right cross-sectional view of a left foot of the present invention taken along line A-A of FIG. 4, with illumination sources omitted for ease of disclosure.
Figure 5B:
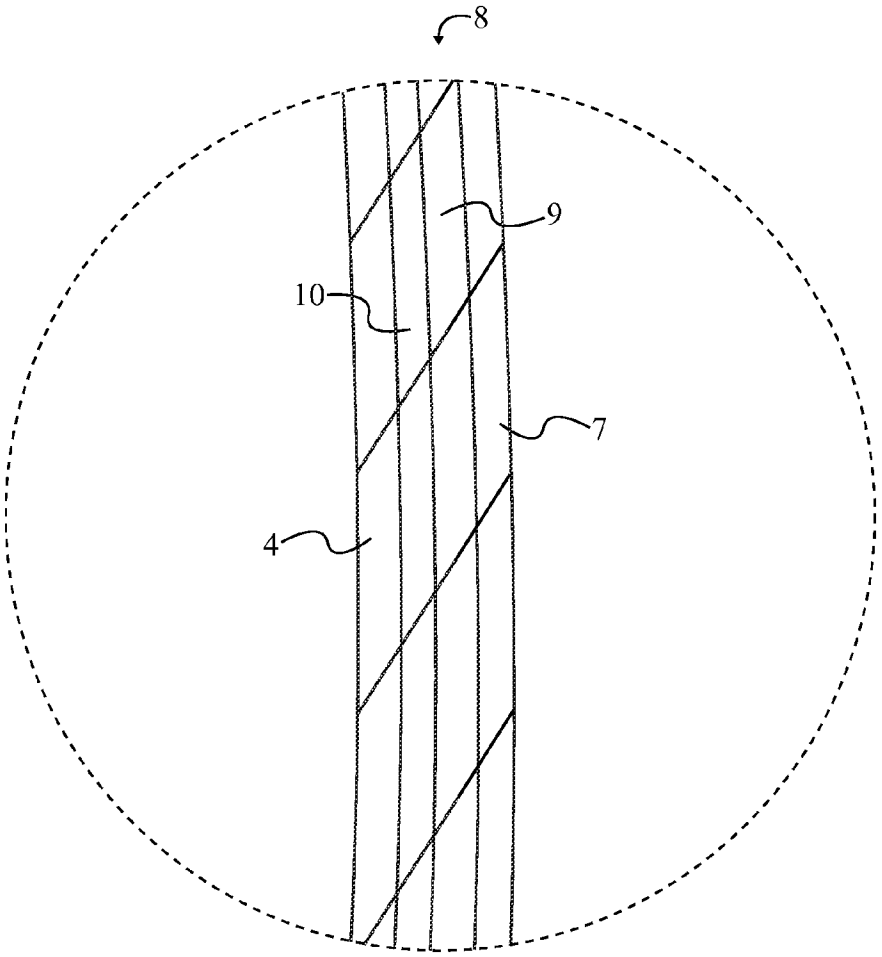
FIG. 5B is a magnified view of the upper and structure shown in FIG. 5A.
Figure 6A:
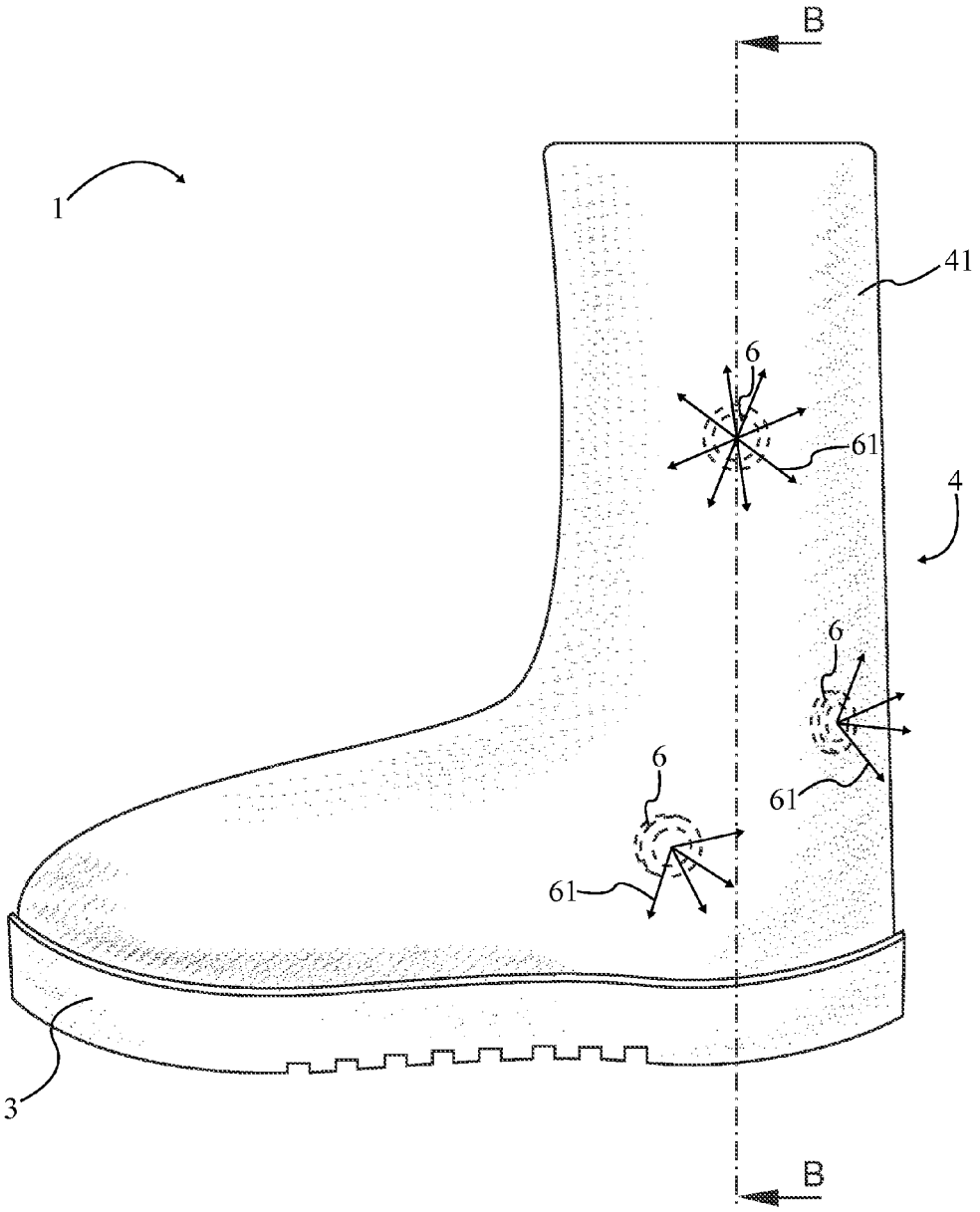
FIG. 6A is a right view of a left foot of the present invention, showing the plane upon which a cross-sectional view is taken and shown in FIG. 6B and FIG. 6D.
Figure 6B:
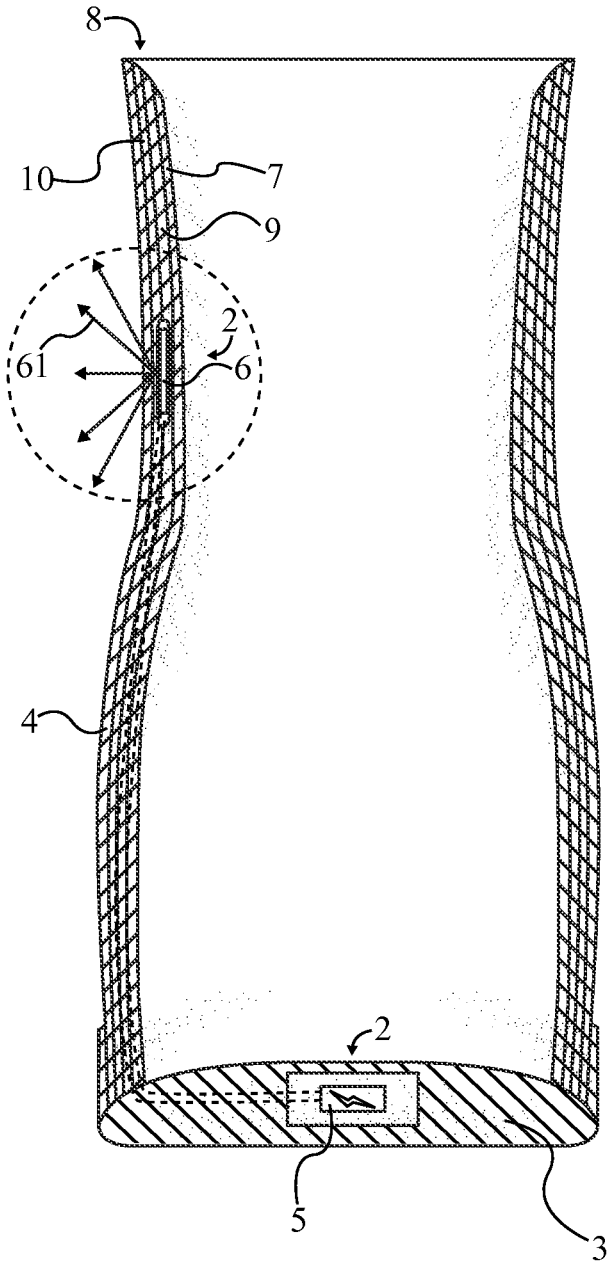
FIG. 6B is a rear cross-sectional view of a left foot of the present invention taken along the line B-B of FIG. 6A, showing the illumination system of the present invention.
Figure 6C:
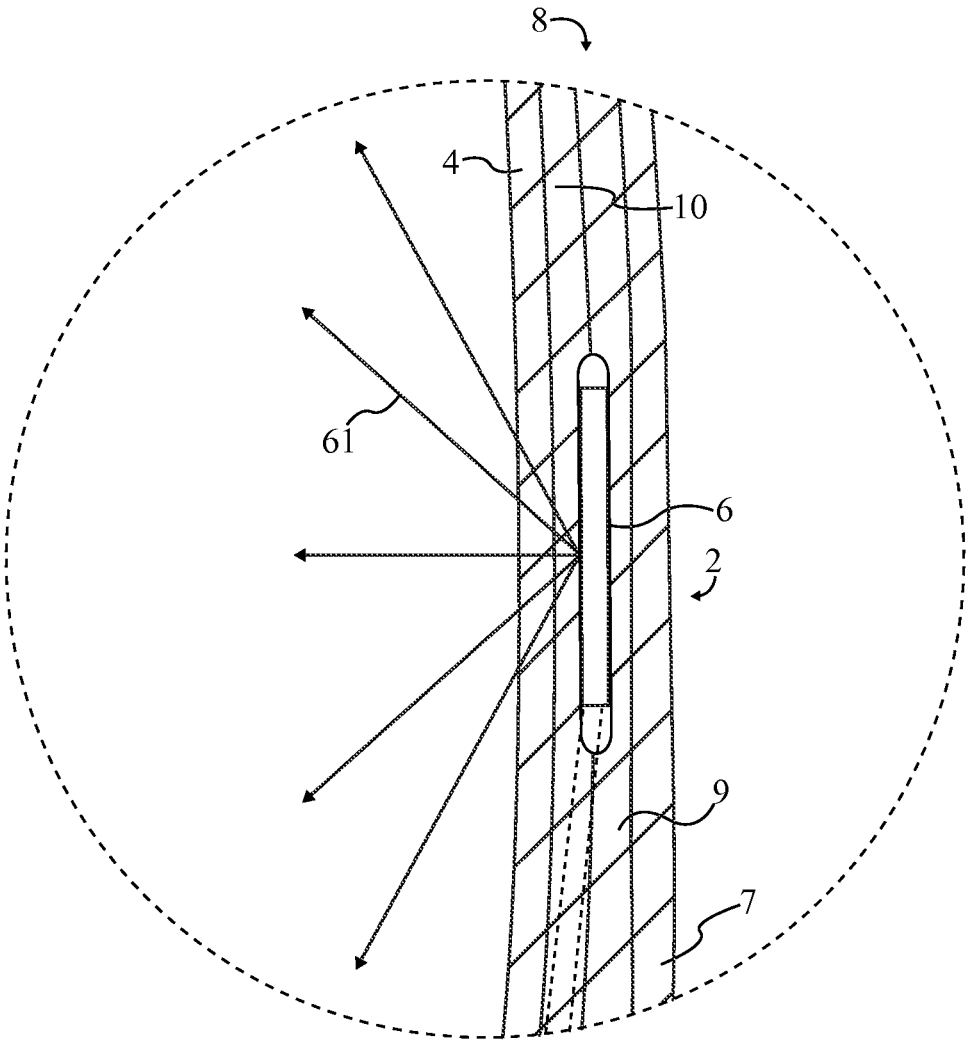
FIG. 6C is a magnified view of the upper and structure shown in FIG. 6B.

The power source 5 is housed within the footwear 1. More specifically, in the preferred first embodiment, the power source 5 is housed within the sole 3. In this preferred embodiment, the sole 3 comprises a housing cavity. The cavity traverses into the sole 3, forming a pocket which is then able to receive and house the power source 5 within the sole 3. The power source 5 is electrically connected to the plurality of illumination sources 6, allowing the power source 5 to provide the necessary energy for operation of the plurality of illumination sources 6. The positioning of the power source 5 is shown in FIG. 5A and FIG. 6B.

Figure 6D:
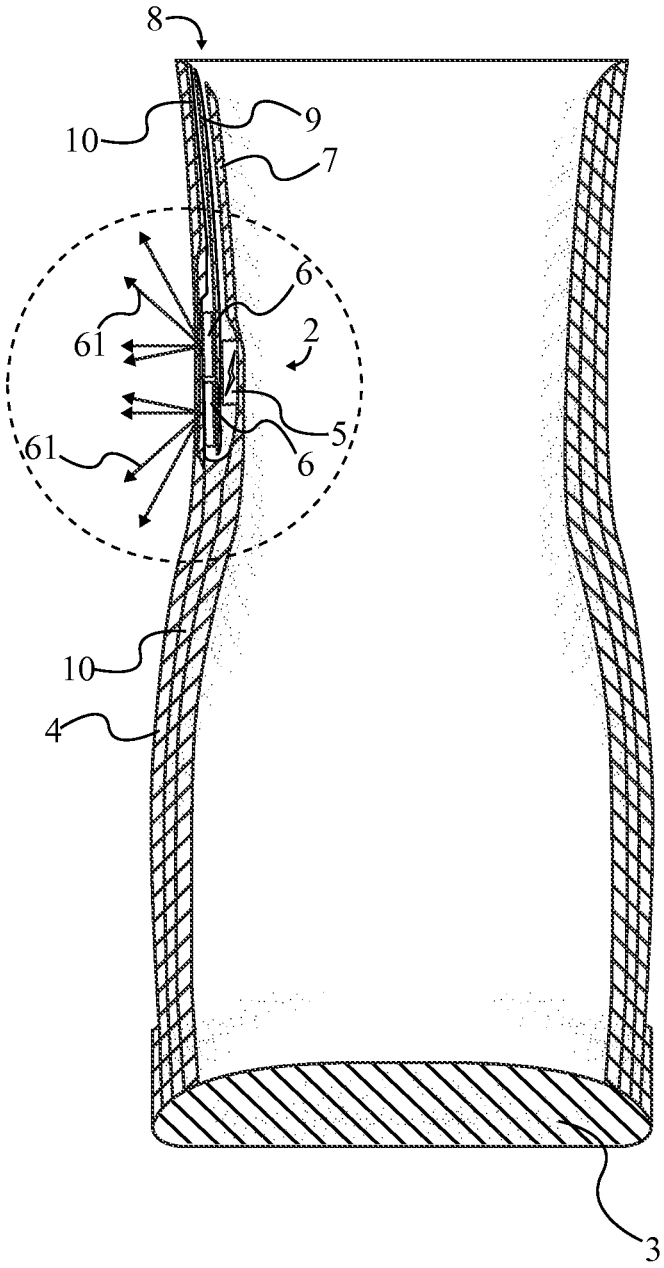
FIG. 6D is a rear cross-sectional view of a left foot of the present invention taken along the line B-B of FIG. 6A, showing an alternate placement of the illumination system of the present invention, including a pocket for receiving the illumination system.
Figure 6E:
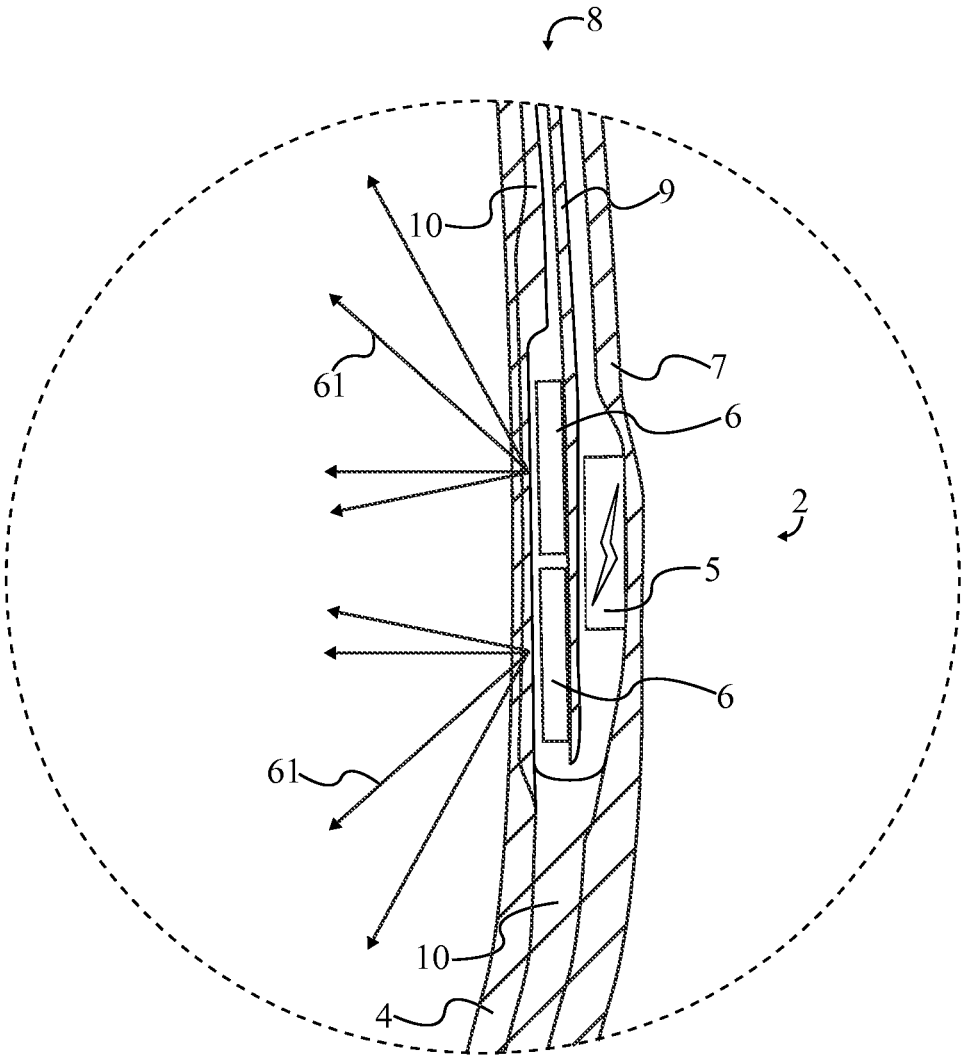
FIG. 6E is a magnified view of the upper and structure shown in FIG. 6D.

Potentially, in another embodiment which is visualized in FIG. 6D, the power source 5 can be housed along with the plurality of illumination sources 6, between the liner 7 and batting 10 which is adjacently connected to the upper 4. In this other embodiment, a pocket is formed between the liner 7 and batting 10, the latter of which is positioned interior to the upper 4. Not only does this pocket hold the power source 5 and plurality of illumination sources 6, it also allows for them to be interchangeable. For example, the illumination sources 6 and power source 5 could be connected to interfacing layer 9. This interfacing layer 9 with power source 5 and illumination sources 6 then serves as a single interchangeable unit. The provision of an interchangeable unit not only allows a manufacturer or vendor to provide replacements, but also different colors, designs and etc. as related to the illumination sources 6. Thus, unlike the preferred first embodiment, the power source 5 is adjacently connected to the liner 7 and positioned between the liner 7 and batting 10, by way of the interfacing layer 9. While this other embodiment could be utilized with any type of footwear 1, it is especially suited for boot type footwear 1, in which the upper 4 further comprises a boot shaft. The boot shaft provides extra space that is not available in athletic shoes, sandals, and similar types of footwear. This extra space makes the application of a pocket and removable illumination sources 6 more reasonable. An example of the present invention with a pocket provided for the illumination system 2 is provided in FIG. 6D and FIG. 6E.

In the preferred embodiment, the illumination system 2 is spread across the sole 3 (which houses the power source 5) and the upper 4 section (where the plurality of illumination sources 6 are secured between the liner 7 and batting 10 of the upper 4, by way of the interfacing layer 9. Because the plurality of illumination sources 6 are positioned in the interior region of the footwear 1, their visible light 61 is diffused as it passes through the batting 10 and the light diffusing section 41 of the upper 4. By diffusing the light 61 from the plurality of illumination sources 6, the present invention internally illuminates the upper 4 with soft and radiant illumination from illumination sources 6.

While several embodiments of the present invention have been described in conjunction with a batting 10 component, the batting component 10 can be omitted if desired. The omission of the batting 10 results in a slightly different configuration for some components, the differences being subsequently described.

The interfacing layer 9, now without the batting 10, is connected to the upper 4 on an interior area of the footwear 1. The interfacing layer 9 is placed between the liner 7 and the upper 4, such that it is effectively enclosed between by the upper 4 and liner 7. The plurality of illumination sources 6 is still connected to the interfacing layer 9, opposite the liner 7. Resultantly, the plurality of illumination sources 6 is positioned between the interfacing layer 9 and the upper 4. As the upper 4 is a light diffusing section 41, the illumination sources 6 mounted to the interfacing layer 9 emits light 61 which enters the light diffusing section 41 where the light is diffused and spread out across a larger area of upper 4 which creates the visual effect of diffused light sources.

Similarly, in an embodiment with a light diffusing layer 12, the light diffusing layer 12 is adjacently connected to the interfacing layer 9 rather than the batting 10. In order to diffuse light as intended, the light diffusing layer 12 is positioned to that side of the interfacing layer 9 containing the illumination sources 6, opposite the liner 7. This positioning allows light 61 from the plurality of illumination sources 6 to pass through the light diffusing layer 12.

Paralleling the configuration of the light diffusing layer 12 in an embodiment without the batting 10, a stencil layer 14 can be adjacently connected to the interfacing layer 9 opposite the liner 7. This positions the stencil layer 14 to that side of the interfacing layer 9 containing the illumination sources 6, where it is able to create a stencil effect in conjunction with the plurality of illumination sources 6.

By utilizing the configurations described above, the batting 10 of the present invention can be omitted without precluding the use of any of the embodiments described earlier. Thus a light diffusing layer 12 and stencil layer 14 can still be implemented even in the absence of the batting 10.

The layering of a structure with a light diffusing outer material (i.e. the upper 4 as heretofore described) can be applied to a number of other garments or apparel, some examples including earmuffs, headware, jackets, handwear, and backpacks. The examples provided below all incorporate the illumination system 2 as earlier described, along with an interfacing layer 9 (to which the illumination system 2 is mounted) and an outer layer that covers the interfacing layer 9. The outer layer is the equivalent of the upper 4 in the footwear embodiment described earlier; the outer layer forms the basis for an aesthetic design 11 via the application of making the outer layer light impermeable, providing an additional stencil layer 14, making aesthetic cuts 13, or configuring the plurality of illumination sources 6 into an aesthetic design 11. The primary differences between these variations and the earlier described embodiments are the base item (e.g. headwear rather than footwear) which the structure 8, illumination system 2, and outer material are incorporated into. These embodiments still diffuse light 61 from an internal source and provide the ability to create illuminated aesthetic designs 11, just as with the footwear embodiment.

Describing the earmuff example in more detail, the earmuff comprises a headband (with two free ends) and a pair of muffs, with a first muff being perimetrically connected to one end of the headband and a second muff being perimetrically connected to opposite end of the headband. A plurality of illumination sources 6 are positioned between the inner ear protective layer and the muff, interior to the earmuff, thus internally illuminating the earmuff. The earmuff further comprises a inner ear protective layer and a structure 8, each of which are positioned in the interior of the earmuff. The structure 8 is designed to be adjacently connected to the inner surface of the muff, with the structure 8 resultantly being positioned between the inner ear protective layer and the muff. The structure 8 itself comprises an interfacing layer 9 and a stuffing, which enhance the visual aspects of the illumination sources 6 of the present invention. The interfacing layer 9 is a reflective layer that serves as a connection point for the plurality of illumination sources 6, that are adjacently connected to the interfacing layer 9 opposite the inner ear protective layer. Ultimately, the plurality of illumination sources 6 are positioned between the interfacing layer 9 and the stuffing. The reflective interfacing layer 9 maximizes the amount of light 61 that exits through the stuffing, while the stuffing serves as a first layer of light diffusion, distributing light over a larger area of stuffing, before the light exits the stuffing and into the diffusing section of the muff.

Describing the hat example in more detail, the headwear comprises a base layer and an outer layer, along with a liner 7 and structure 8 (the latter paralleling components of the earlier described footwear embodiment). The structure 8 is designed to be adjacently connected to the inner surface of the outer layer, with the structure 8 resultantly being positioned between the liner 7 and the outer layer. An interfacing layer 9 and an insulation layer of the structure 8 enhance the visual aspects of the illumination sources 6 of the present invention. The illumination sources 6 are connected to the structure 8, allowing light 61 to be emitted and diffused through corresponding components. The outer layer parallels the upper of the footwear embodiment; thus a light impermeable section, aesthetic design 11, or stencil layer 14 can be incorporated into the outer layer, as well as the structure 8 where applicable.

Describing the jacket example in more detail, a jacket body comprises an exterior textile layer. A liner 7 and structure 8 are positioned in the interior of the jacket. The structure 8 is designed to be adjacently connected to the inner surface of the exterior textile layer, with the structure 8 resultantly being positioned between the liner 7 and the exterior textile layer. The structure 8 itself comprises an interfacing layer 9 and an insulating material, which enhance the visual aspects of the illumination sources 6 of the present invention. The structure 8 of the jacket is thus similar to the structure 8 of the headwear. The interfacing layer 9 is a reflective layer that serves as a connection point for the plurality of illumination sources 6, that are adjacently connected to the interfacing layer 9 opposite the liner 7. Ultimately, the plurality of illumination sources 6 is positioned between the interfacing layer 9 and the insulating material. The reflective interfacing layer 9 maximizes the amount of light 61 that exits through the insulating material, while the insulating material serves as a first layer of light diffusion, distributing light 61 over a larger area of insulating material, before the light 61 exits the insulating material and into the diffusing section of the exterior textile layer. After entering the diffusing section the light 61 is once again diffused and spread out across a larger area of the exterior textile layer which creates the visual effect of diffused light sources.

Describing the handwear in more detail, the handwear comprises an exterior shell. Interior to the exterior shell are a liner 7 and a structure 8. The structure 8 is designed to be adjacently connected to the inner surface of the exterior shell, with the structure 8 resultantly being positioned between the liner 7 and the exterior shell. The structure itself comprises an interfacing layer 9 and an insulating layer, which enhance the visual aspects of the illumination sources 6 of the present invention. The interfacing layer 9 is a reflective layer that serves as a connection point for the plurality of illumination sources 6, that are adjacently connected to the interfacing layer 9 opposite the liner 7.

Describing the backpack in more detail, the backpack comprises an outer surface, with the outer surface being connected to each end of a pair of shoulder straps. The present invention further comprises a liner 7 and a structure 8, each of which are positioned in the interior of the backpack. The structure 8 is designed to be adjacently connected to the inner surface of the outer surface, with the structure 8 resultantly being positioned between the liner 7 and the outer surface. The structure 8 itself comprises an interfacing layer 9 and a batting 10, which enhance the visual aspects of the illumination sources 6 of the present invention. The interfacing layer 9 is a reflective layer that serves as a connection point for the plurality of illumination sources 6, that are adjacently connected to the interfacing layer 9 opposite the liner 7.

Although the invention has been explained in relation to its preferred embodiment, it is to be understood that many other possible modifications and variations can be made without departing from the spirit and scope of the invention as hereinafter claimed.

What is claimed is:

1. An internally illuminated textile footwear comprises:
- a sole and an upper;
- an illumination system;
- the illumination system comprises a power source and a plurality of illumination sources;
- a liner;
- an interfacing layer;
- the interfacing layer being adjacently connected to the upper;
- the interfacing layer being positioned between the liner and the upper;
- the plurality of illumination sources being adjacently connected to the interfacing layer;
- the plurality of illumination sources being positioned between the interfacing layer and the upper;
- the upper being perimetrically connected to the sole;
- the liner being positioned interior to the upper;
- the upper being a light diffusing section;
- the illumination system being housed within the footwear; and
- the plurality of illumination sources emitting light, wherein the light enters the light diffusing section, then exits the upper as diffused light, creating a visual impression of internal radiant illumination across an outer surface of the upper.

2. The internally illuminated textile footwear as claimed in claim 1 comprises:
- a light diffusing layer;
- the light diffusing section being configured as an at least one aesthetic cut;
- the at least one aesthetic cut traversing through the upper;
- the light diffusing layer being adjacently connected to the interfacing layer opposite the liner;
- the light diffusing layer being configured as an aesthetic design; and
- the light diffusing layer being perimetrically aligned with the at least one aesthetic cut.

3. The internally illuminated textile footwear as claimed in claim 1 comprises:
- a stencil layer;
- the stencil layer comprises an at least one aesthetic cut;
- the stencil layer being adjacently connected to the interfacing layer opposite the liner;
- the at least one aesthetic cut traversing through the stencil layer;
- the stencil layer being light impermeable; and
- the plurality of illumination sources being positioned adjacent to the at least one aesthetic cut.

4. The internally illuminated textile footwear as claimed in claim 1 comprises:
- a stencil layer;
- the stencil layer being adjacently connected to the interfacing layer opposite the liner;
- the stencil layer being light impermeable; and
- the stencil layer being configured as an aesthetic design, wherein illumination from the plurality of illumination sources delineates the aesthetic design.

5. The internally illuminated textile footwear as claimed in claim 1 comprises:
- the power source being housed within the sole.

6. The internally illuminated textile footwear as claimed in claim 1 comprises:
- the power source being adjacently connected to the liner; and
- the power source being positioned between the liner and the upper.

7. The internally illuminated textile footwear as claimed in claim 1 comprises:
- the plurality of illumination sources being configured into an aesthetic design.

8. The internally illuminated textile footwear as claimed in claim 1 comprises:
- the upper further comprises a light impermeable section.

9. The internally illuminated textile footwear as claimed in claim 8 comprises:
- the light diffusing section being configured as an aesthetic design, wherein the plurality of illumination sources illuminates the aesthetic design;
- the aesthetic design being delineated by the light impermeable section; and
- the plurality of illumination sources being overlapped by the light diffusing section.

10. The internally illuminated textile footwear as claimed in claim 8 comprises:
- the light impermeable section being configured as an aesthetic design, wherein illumination from the plurality of illumination sources delineates the aesthetic design;

the aesthetic design being delineated by the light diffusing section; and the plurality of illumination sources being overlapped by the light impermeable section.

* * * * *